United States Patent [19]

Rautio

[11] Patent Number: 4,583,576

[45] Date of Patent: Apr. 22, 1986

[54] MEANS FOR FEEDING A TREE TRUNK

[76] Inventor: Kauko Rautio, Kolmihaarantie, 52700 Mäntyharju, Finland

[21] Appl. No.: 634,166

[22] Filed: Jul. 25, 1984

[30] Foreign Application Priority Data

Aug. 3, 1983 [FI] Finland ..... 832798

[51] Int. Cl.[4] ..... B27B 25/02

[52] U.S. Cl. ..... 144/246 E; 144/249 A; 144/247

[58] Field of Search ..... 144/4, 242 R, 242 C, 144/242 H, 246 R, 246 A, 246 D, 246 E, 246 F, 247, 249 R, 245 R; 198/456, 624, 721, 722

[56] References Cited

U.S. PATENT DOCUMENTS 3,724,518 4/1973 Zehavi et al. ..... 144/247
4,078,592 3/1978 Standal ..... 144/242 R

FOREIGN PATENT DOCUMENTS 891447 12/1981 U.S.S.R. ..... 144/242 R

*Primary Examiner*—W. D. Bray
*Assistant Examiner*—J. Griffin
*Attorney, Agent, or Firm*—Martin Smolowitz

[57] ABSTRACT

A device for feeding a tree trunk with lateral and vertical centering into a machine processing round timber. Heretofore, the feeding of the log into the machine has taken place manually, which is exceedingly heavy work. The invention comprises a feed gutter and a spring wheel both serving as points of support, at least one feed wheel, and opposite thereof a carrying wheel.

8 Claims, 1 Drawing Figure

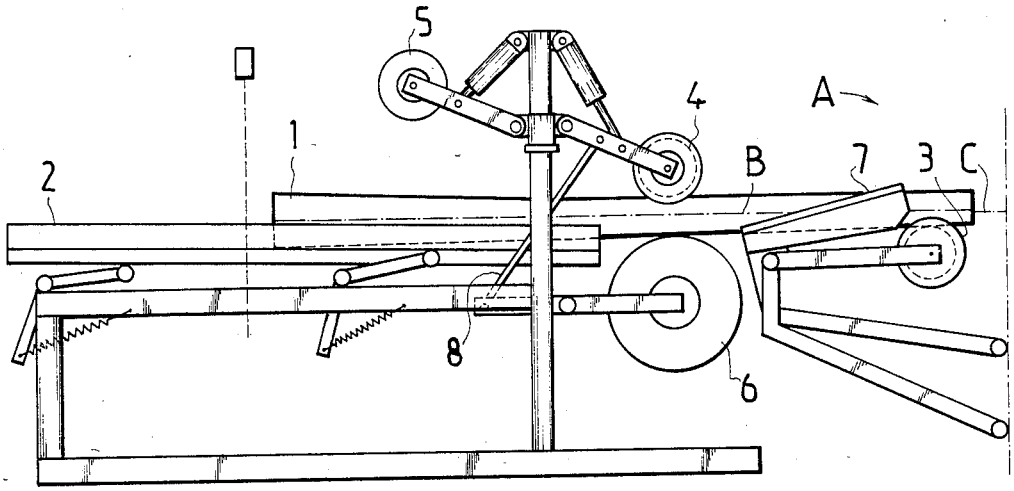
5
4
A
1
B
7
3
C
2
8
6

MEANS FOR FEEDING A TREE TRUNK

BACKGROUND OF THE INVENTION

The present invention concerns a means for feeding a tree trunk into a machine processing round timber, with centering of the trunk in the lateral and vertical directions.

When feeding a log into round timber processing machines of certain types, e.g. hewing machines, hewing saws or butt end trimmers, one has to be able to supply or feed, the log to the processing cutters or blades, in a way ensuring that it is centered in lateral and vertical direction in accordance with said processing cutters' center-line (e.g., Finnish patent application No. 792067). In addition, the log must, before it is fed in between the processing cutters or blades, be rotated into proper position in view of its crookedness, for instance with the convex side downwards. Rotating a crooked log has heretofore been done manually or mechanically with complicated structures in which, for instance, rotation of the log being fed is accomplished with two pairs of chains in which the chains are placed at a V-angle with reference to each other. Pairs of wheels have also been used heretofore, the log being turned into correct position by accordingly rotating these wheels. One way is to feed the log through between opposed wheels rotatable about axles which are longitudinal as seen in the direction of the log, turning being accomplished by adjusting the axial lines of the wheels with reference to each other. Furthermore, it has been possible to guide the log through between vertical, spring-loaded roller sets, thus forcing the log at it passes through between the rollers into proper feeding position in view of its crookedness.

The problem in the rotating methods mentioned above is, however, undoubtedly the fact that they fail to center the log both in the vertical and in the lateral direction and that the feeding machines have a complex design, being therefore expensive and requiring much maintenance work.

DESCRIPTION OF INVENTION

The present invention eliminates the drawbacks mentioned, and provides a new type of feeding means which turns a crooked log into the correct position and at the same time centers it vertically and laterally i.e. sidewise.

In the following, the invention is described in detail with reference to the attached drawing.

The FIGURE presents, schematically, a means according to the invention, comprising an obtuse V-angled feed gutter 2 and a spring wheel 3, both serving as points of support for a log 1, at least one feed wheel 4, and a carrying wheel 6 opposite the feed wheel. The initial end of the feed gutter 2, as viewed in the feeding direction A of the log, is at a higher elevation than the ultimate end. For the log 1 to be able without impediment to position itself on the feed gutter 2 and the spring wheel 3, a guide cutter 7 is provided before the spring wheel 3 and the feed wheel 4 is in a high enough position to not interfere. The spring wheel 3 and feed wheel 4 are concave shaped to provide a laterally centering effect.

When the forward end (as viewed in the feed direction) of a crooked log lies on spring wheel 3 and its rear end lies on feed gutter 2, the crooked log tends, under the effect of gravity, to turn about its longitudinal axis so it lies with its convex side downward. The feed gutter and spring wheel have been provided with spring suspension, so that the longitudinal centreline B of the log will lie above the feed line C. With the log 1 resting on the feed gutter 2 and the spring wheel 3, the feed wheel 4 first bears down on the log, whereby the force which it exerts on the log and the shape of said feed wheel 4 cause the crooked log to turn its convex side downwards. As the feed wheel 4 presses against the log 1, the springs of the feed gutter 2 and spring wheel 3 yield downwardly. The carrying or supporting wheel 6 which is synchronized with the aid of a transmission member such as a rod 8 to operate in conformity with the movements of the feed wheel 4, now ascends, whereby the log 1 is clamped between the supporting wheel 6 and the feed wheel 4 while on the feed line, and the log 1 will be fed into the processing machine. Since the feed wheel 4 and the spring wheel 3 are concave shaped so as to develop a lateral centering effect for the log, the feeding of the log will proceed in correct position as regards the crookedness of the log, and with proper centering in both the lateral and vertical directions.

I claim:

1. A feeding means for laterally and vertically centering a tree trunk which is to be fed into a machine for processing round timber, said tree trunk being curved in the longitudinal direction forming convex and concave longitudinal sides, and having longitudinally opposite ends, wherein the feed means comprises: a feed gutter, a spring wheel located downstream of the feed gutter, both said feed gutter and said spring wheel serving as underlying points of support for the trunk ends, at least one feed wheel located above the trunk and a carrying wheel for supporting the tree trunk located opposite the feed wheel.

2. A feeding means according to claim 1, wherein the tree trunk is carried intermediate its ends by the carrying wheel, the tree trunk having been rotated by gravity so that its convex side is downward and its ends contiguous with the points of support.

3. A feeding means according to claim 1, wherein the feed gutter and spring wheel are each provided with a spring suspension means.

4. A feeding means according to claim 1, wherein the carrying wheel has been synchronized by aid of a transmission member to operate in conformity with the movements of the opposed feed wheel.

5. A feeding means according to claim 1, wherein at least one feed wheel, is adapted to receive an actuation pulse by means of a photocell.

6. A feeding means according to claim 1, wherein the sides of the feed gutter meet to form an obtuse V angle, and guide gutter is provided before the spring wheel.

7. A feeding means according to claim 1, wherein both the at least one feed wheel and the spring wheel are concavely shaped to exert a lateral centering effect on the tree trunk being fed.

8. A feed means for alterally and vertically centering a tree trunk which is to be fed into a machine for processing round timber, said tree trunk having longitudinally opposite ends, said feed means comprising:

(a) a feed gutter the sides of which meet to form obtuse V angle;

(b) a spring wheel located downstream of the feed gutter, the feed gutter and the spring wheel both serving as underlying points of support for the tree trunk;

(c) at least one concave shaped feed wheel located above the tree trunk; and (d) a concave shape carrying wheel located opposite the feed wheel and synchronized by the aid of a transmission member to operate in conformity with the movements of the opposed feed wheel, whereby the tree trunk is rotated about its longitudinal center line and having its ends contiguous with said points of support.

* * * * *